US006544132B1

(12) United States Patent
Tvedt

(10) Patent No.: US 6,544,132 B1
(45) Date of Patent: Apr. 8, 2003

(54) BASKETBALL PRACTICE SYSTEM

(76) Inventor: Ryan Tvedt, 215 - 2nd Ave. SE., Watertown, SD (US) 57201

( * ) Notice: Subject to any disclaimer, the term of this patent is extended or adjusted under 35 U.S.C. 154(b) by 0 days.

(21) Appl. No.: 09/797,615

(22) Filed: Mar. 5, 2001

(51) Int. Cl.[7] ..... A63B 69/00; A63B 63/00; F41J 1/00; F41J 3/00

(52) U.S. Cl. ..... 473/448; 473/447; 273/402

(58) Field of Search ..... 473/422, 472, 473/431–435, 447, 448, 449, 479, 481–489, FOR 101; 273/402, 317.3

(56) References Cited

U.S. PATENT DOCUMENTS

| | | | | | |
|---|---|---|---|---|---|
| 906,392 | A | * | 12/1908 | Dietz | 434/11 |
| 2,039,794 | A | | 5/1936 | Hayden | |
| 2,939,705 | A | * | 6/1960 | McCall, Jr. | 473/449 |
| 4,079,939 | A | | 3/1978 | Raistakka | |
| 4,295,648 | A | * | 10/1981 | Stromback | 273/402 |
| 4,828,270 | A | | 5/1989 | Chiang | |
| 5,558,323 | A | | 9/1996 | LoFaso, Sr. | |
| 5,599,016 | A | | 2/1997 | Larkin | |
| 5,642,879 | A | | 7/1997 | Rodriguez | |
| 5,665,016 | A | | 9/1997 | Burnett | |
| 5,738,600 | A | | 4/1998 | Fouts et al. | |
| 5,813,926 | A | | 9/1998 | Vance | |
| 5,833,556 | A | * | 11/1998 | Ferrari | 473/448 |
| 6,159,111 | A | * | 12/2000 | Purcell | 473/447 |
| 6,312,349 | B1 | * | 11/2001 | Roberts | 473/446 |

* cited by examiner

*Primary Examiner*—Paul T. Sewell
*Assistant Examiner*—Mitra Aryanpour

(57) ABSTRACT

A basketball practice system for providing a portable assembly positionable between the shooter and the basketball hoop for teaching proper arcing when shooting a basketball. The basketball practice system includes a base assembly, a support assembly, and a frame assembly having an opening positionable at a predetermined height between a shooter and a basketball hoop given a pre-determined shooting distance between the shooter and the basketball hoop.

17 Claims, 6 Drawing Sheets

BASKETBALL PRACTICE SYSTEM

BACKGROUND OF THE INVENTION

1. Field of the Invention

The present invention relates to basketball training systems and more particularly pertains to a new basketball practice system for providing a portable assembly positionable between the shooter and the basketball hoop for teaching proper arcing when shooting a basketball.

2. Description of the Prior Art

The use of basketball training systems is known in the prior art. More specifically, basketball training systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,813,926; U.S. Pat. No. 4,079,939; U.S. Pat. No. 4,828,270; U.S. Pat. No. 5,558,323; U.S. Pat. No. 2,039,794; U.S. Pat. No. 5,738,600; U.S. Pat. No. 5,665,016; U.S. Pat. No. 5,642,879; and U.S. Pat. No. 5,599,016.

While these devices fulfill their respective, particular objectives and requirements, the aforementioned patents do not disclose a new basketball practice system. The inventive device includes a base assembly, a support assembly, and a frame assembly having an opening positionable at a predetermined height between a shooter and a basketball hoop given a pre-determined shooting distance between the shooter and the basketball hoop.

In these respects, the basketball practice system according to the present invention substantially departs from the conventional concepts and designs of the prior art, and in so doing provides an apparatus primarily developed for the purpose of providing a portable assembly positionable between the shooter and the basketball hoop for teaching proper arcing when shooting a basketball.

SUMMARY OF THE INVENTION

In view of the foregoing disadvantages inherent in the known types of basketball training systems now present in the prior art, the present invention provides a new basketball practice system construction wherein the same can be utilized for providing a portable assembly positionable between the shooter and the basketball hoop for teaching proper arcing when shooting a basketball.

The general purpose of the present invention, which will be described subsequently in greater detail, is to provide a new basketball practice system apparatus and method which has many of the advantages of the basketball training systems mentioned heretofore and many novel features that result in a new basketball practice system which is not anticipated, rendered obvious, suggested, or even implied by any of the prior art basketball training systems, either alone or in any combination thereof.

To attain this, the present invention generally comprises a base assembly, a support assembly, and a frame assembly having an opening positionable at a predetermined height between a shooter and a basketball hoop given a predetermined shooting distance between the shooter and the basketball hoop.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new basketball practice system apparatus and method which has many of the advantages of the basketball training systems mentioned heretofore and many novel features that result in a new basketball practice system which is not anticipated, rendered obvious, suggested, or even implied by any of the prior art basketball training systems, either alone or in any combination thereof.

It is another object of the present invention to provide a new basketball practice system that may be easily and efficiently manufactured and marketed.

It is a further object of the present invention to provide a new basketball practice system that is of a durable and reliable construction.

An even further object of the present invention is to provide a new basketball practice system which is susceptible of a low cost of manufacture with regard to both materials and labor, and which accordingly is then susceptible of low prices of sale to the consuming public, thereby making such basketball practice system economically available to the buying public.

Still yet another object of the present invention is to provide a new basketball practice system which provides in the apparatuses and methods of the prior art some of the advantages thereof, while simultaneously overcoming some of the disadvantages normally associated therewith.

Still another object of the present invention is to provide a new basketball practice system for providing a portable assembly positionable between the shooter and the basketball hoop for teaching proper arcing when shooting a basketball.

Yet another object of the present invention is to provide a new basketball practice system which includes a base assembly, a support assembly, and a frame assembly having an opening positionable at a predetermined height between a shooter's release point and a basketball hoop given a pre-determined shooting distance between the shooter and the basketball hoop.

Still yet another object of the present invention is to provide a new basketball practice system that teaches a proper shooting arc by requiring a shooter to repeatedly shoot a basketball through an opening positioned at a pre-determined position between the shooter and a basketball hoop to produce an optimum approach angle for the basketball as it approaches the basketball hoop.

Even still another object of the present invention is to provide a new basketball practice system that provides a lightweight collapsible assembly that may be carried in a storage bag.

Yet still another object of the present invention is to provide a new basketball practice system that is easily transported to various positions on a basketball court to facilitate practicing shooting from various positions around a basketball hoop.

It is still even another object of the present invention to provide a new basketball practice system that is easily adapted for use with a counter system for tallying successful attempts to shoot a basketball towards a basketball hoop using an optimum arc.

It is even yet another object of the present invention is to provide a new basketball practice system having a frame assembly forming an opening wherein the frame assembly is usable with a contact sensor system for providing an indication of what part of the frame assembly is contacted by an errant shot to assist in correcting and perfecting development of an optimum arc when shooting a basketball.

Even still another object of the present invention is to provide an opening having an adjustable size for altering a level of difficulty for shooting the basketball through the opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
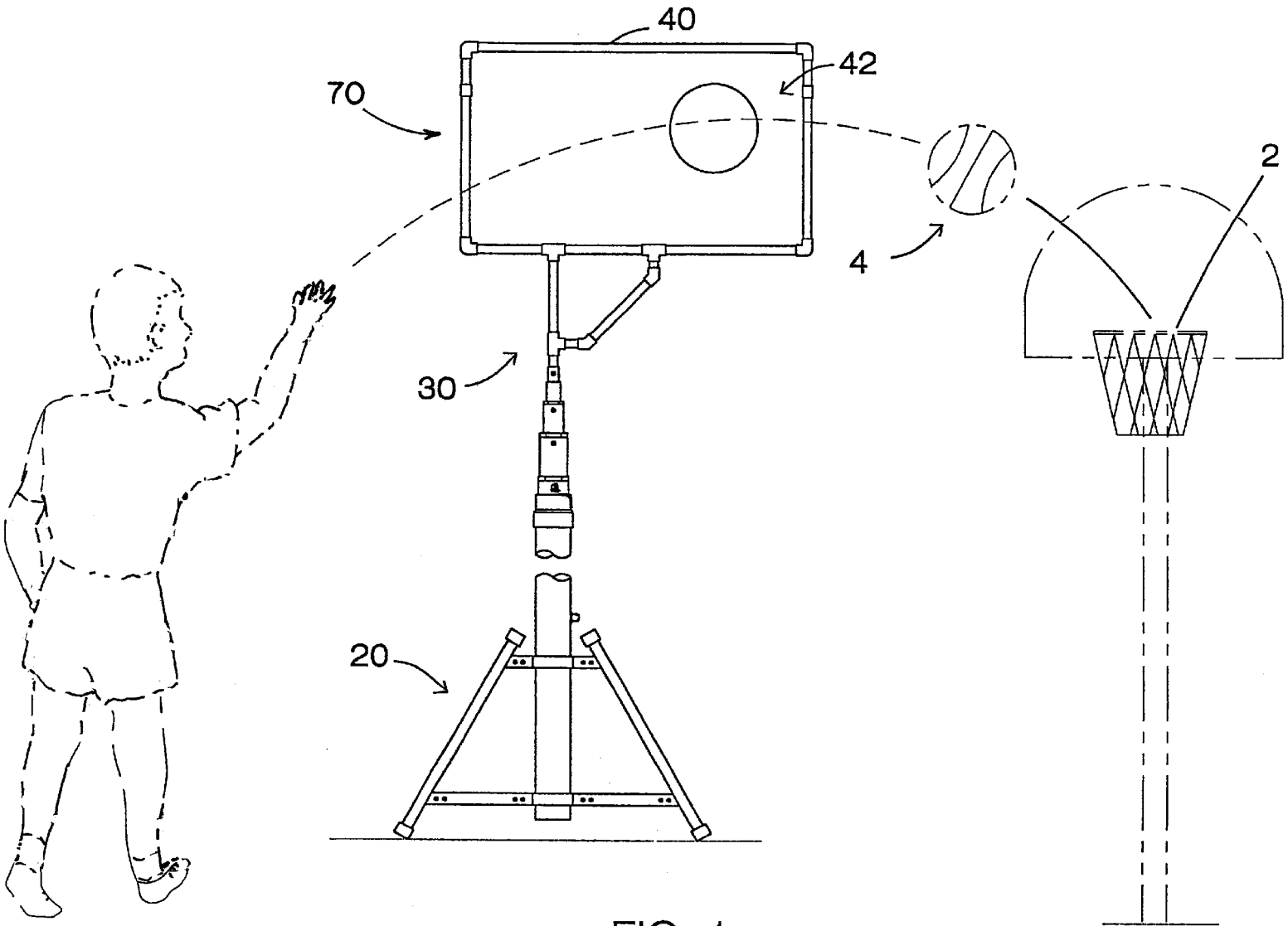
FIG. 1 is a perspective view of a new basketball practice system according to the present invention.
Figure 2:
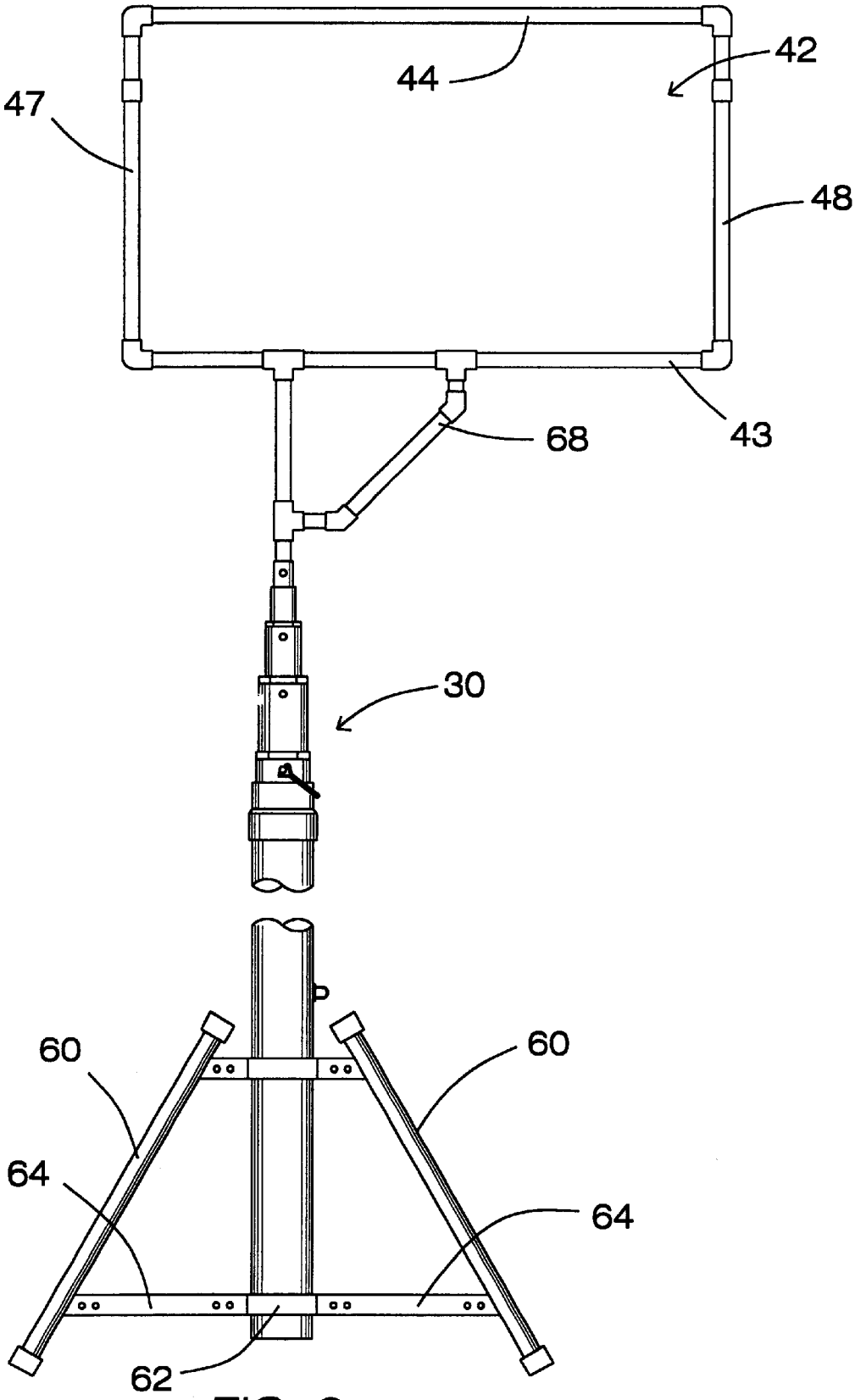
FIG. 2 is a front view of the present invention.
Figure 3:
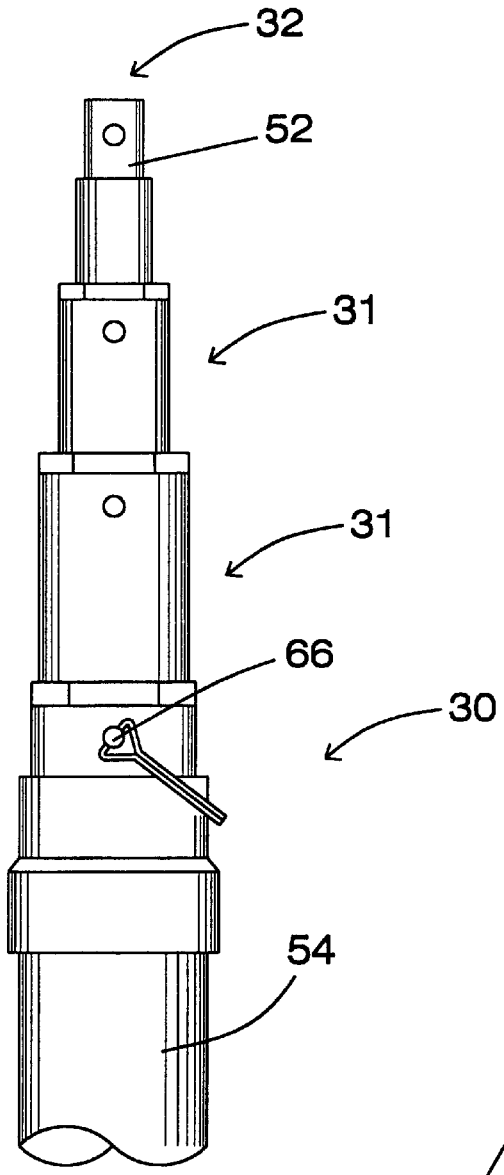
FIG. 3 is a perspective view of the support assembly of the present invention.
Figure 4:
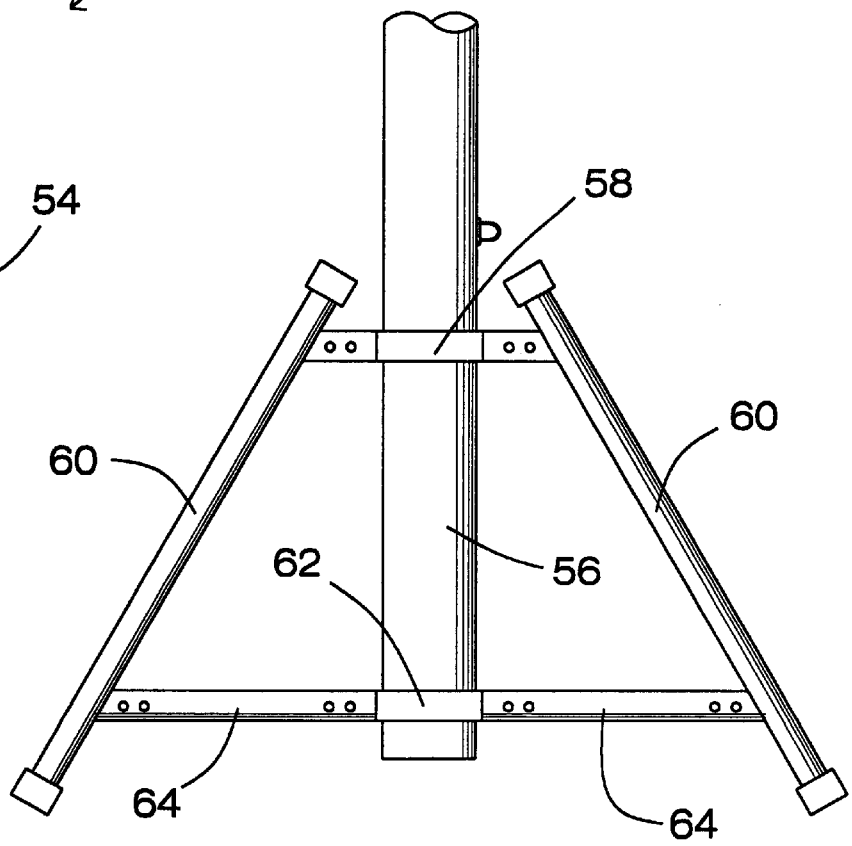
FIG. 4 is a perspective view of the base assembly of the present invention.
Figure 5:
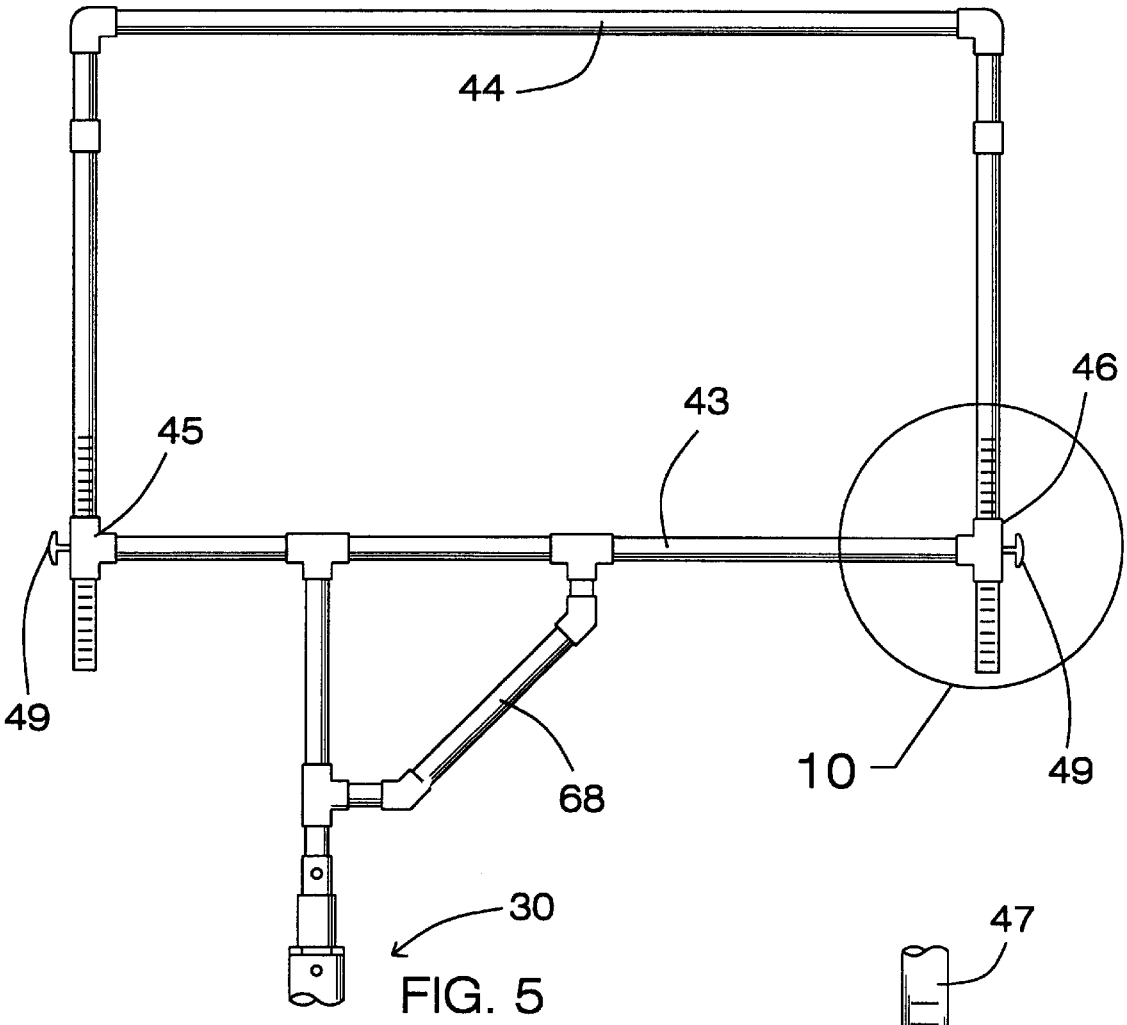
FIG. 5 is a front view of the frame assembly and support assembly of the present invention.
Figure 10:
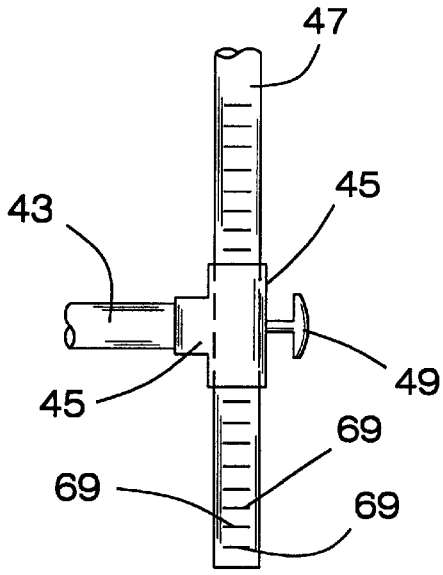
FIG. 10 is an enlarged view of the sleeve member of the frame assembly.
Figure 6:
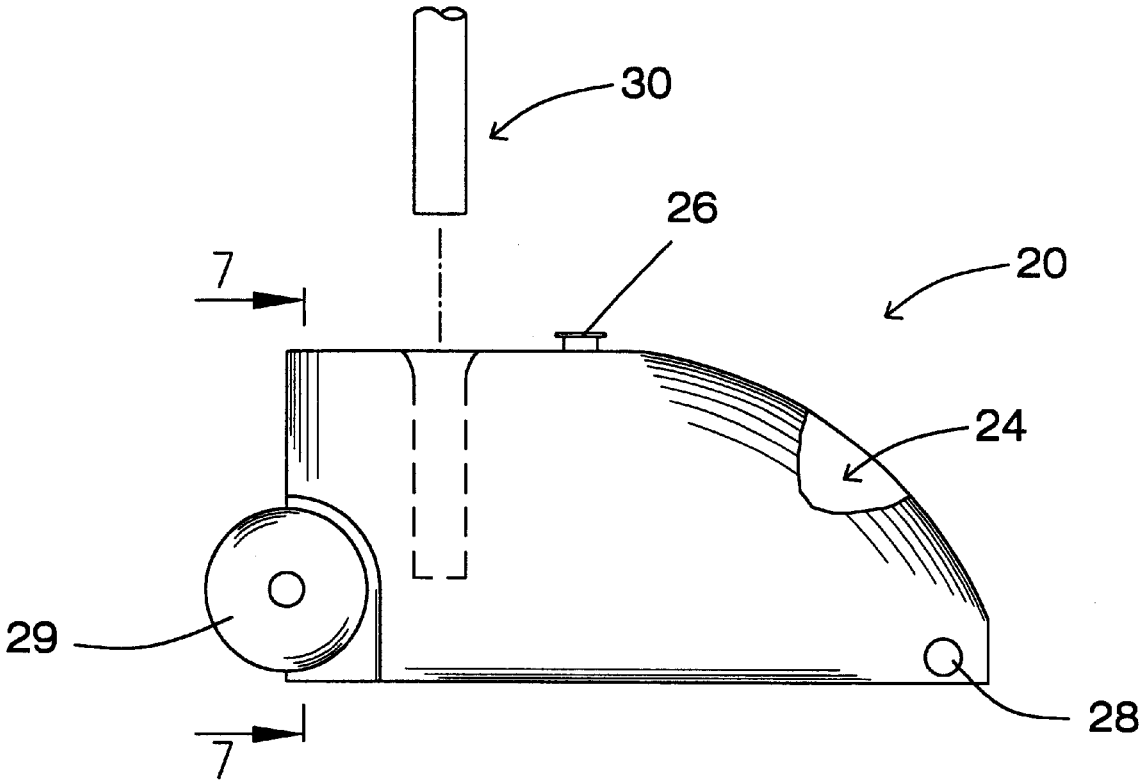
FIG. 6 is a side view of an alternate base assembly of the present invention.
Figure 7:
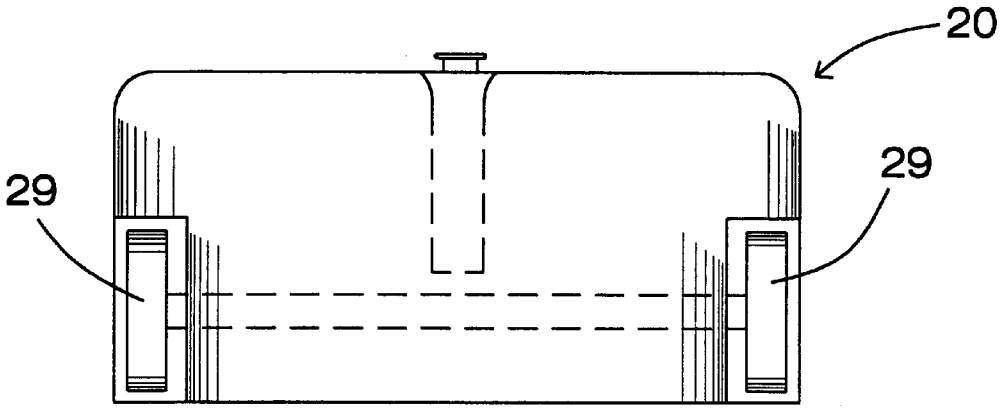
FIG. 7 is a rear view of the alternate base assembly of the present invention.
Figure 8:
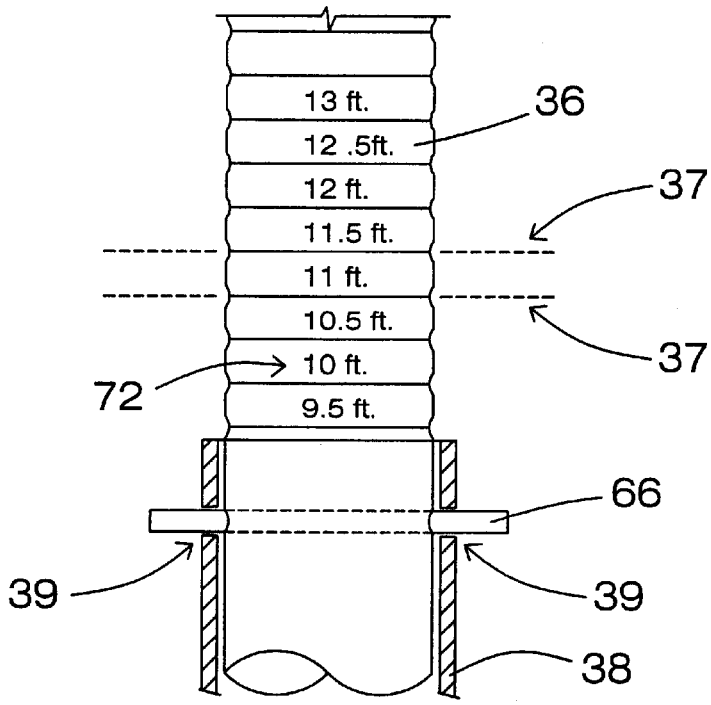
FIG. 8 is a partial cut-away view of the support assembly.
Figure 9:
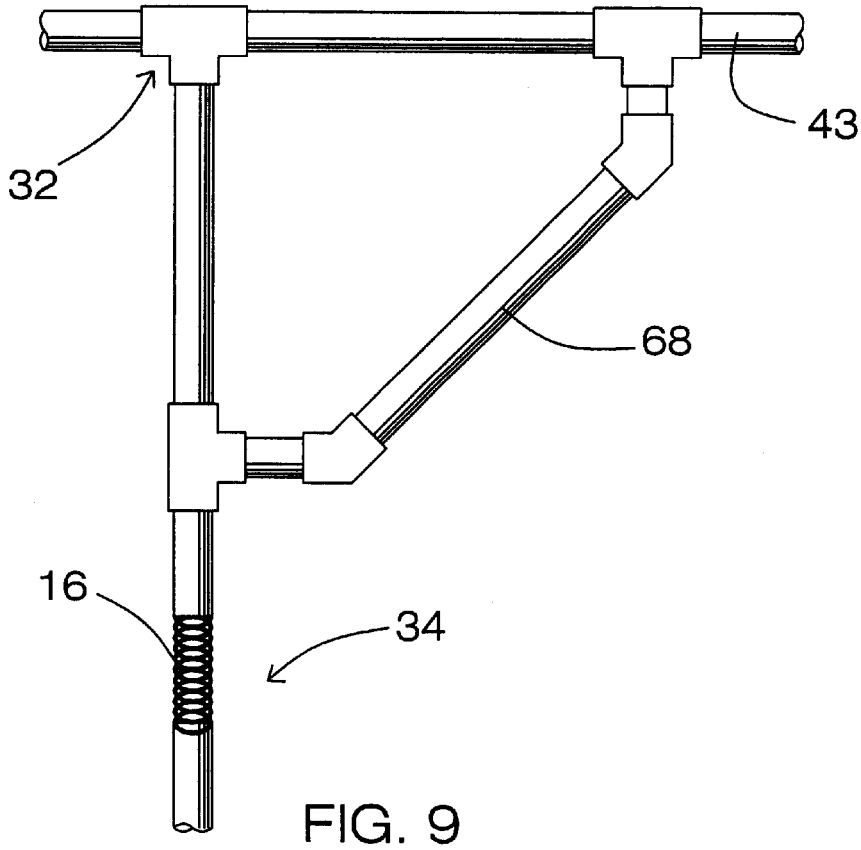
FIG. 9 is a front view of the upper portion of an embodiment of the support assembly.

With reference now to the drawings, and in particular to FIGS. 1 through 10 thereof, a new basketball practice system embodying the principles and concepts of the present invention and generally designated by the reference numeral 70 will be described.

As best illustrated in FIGS. 1 through 10, the basketball practice system 10 generally comprises a base assembly 20, a support assembly 30 extending from the base assembly 20, and a frame assembly 40 coupled to an upper end 32 of the support assembly. The frame assembly 40 forms an opening 42. The base assembly 20 and the support assembly 30 are positionable such that the frame assembly 40 is designed for being easily positioned between a shooter and a basketball hoop 2 such that a basketball 4 shot towards the basketball hoop 2 passes through the opening 42 at a top of an arc of a path of travel of the basketball 4. Thus the basketball 4 approaches the basketball hoop 2 at a desired downward angle for facilitating passing of the basketball 4 through the basketball hoop 2.

The support assembly 30 is telescopically adjustable for adjusting the height of the opening 42 relative to a ground surface supporting the base assembly 30.

In an embodiment, the support assembly includes a biasing member 16 such as a spring coaxially arranged for holding an upper end of the support assembly in an upright position for permitting bending of an upper portion 34 of the support assembly when the frame assembly 40 is struck by the basketball 4. Thus, the upper portion 34 of the support assembly 30 is designed for bending to prevent tipping over of the base assembly 20 when the basketball 4 strikes the frame assembly 40.

In an embodiment, the frame assembly 40 further includes a lower member 43, an upper member 44, a pair of sleeve members 45 and 46, and a pair of side members 47 and 48.

An upper end of each of the side members 47 and 48 is coupled to an associated end of the upper member 44. Each of the sleeve members 45 and 46 is coupled to an associated end of the lower member 43. A lower end of each of the side members 47 and 48 is insertable through an associated one of the sleeve members 45 and 46. A pair of locking means 49 such as a cotter pin or a thumbscrew are provided. Each locking means 49 is designed for selectively holding an associated one of the side members 47 and 48 in a static position relative to the associated one of the sleeve members 45 and 46. Thus, a distance between the upper member 44 and the lower member 43 is adjustable for selectively altering a level of difficulty for shooting the basketball 4 through the opening 42. The side members 47 and 48 may also include frame indicia 69 for facilitating positioning of the side members such that the upper member 44 is level and for facilitating consistent setting of a desired level of difficulty.

An upper end of the support assembly 30 is coupled to the lower member 43 of the frame assembly 40 at a position offset from a center of the lower member 43. Thus the support assembly 30 is positioned offset from a line of sight between the shooter and the basketball hoop 2 for facilitating clear viewing of the basketball hoop 2 by the shooter when the basketball shooting training system 10 is positioned between the shooter and the basketball hoop 2.

In an embodiment, the lower member 43, upper member 44, and the side members 47 and 48 of the frame assembly 40 are removably couplable to each other. Thus, the frame assembly 40 may be taken apart for facilitating storage of the frame assembly 40.

The support assembly 30 includes a first member 36 that has a plurality of aligned aperture pairs 37 extending through the first member 36. The aperture pairs 37 extend along a length of the first member 36. The support assembly 30 also includes a second member 38 that includes a pair of aligned holes 39 alignable with a selectable one of the aperture pairs 37. A pin 66 is insertable through the aligned holes 39 and the selectable one of the aperture pairs 37. Thus, the first member 36 is held in a static position relative to the second member 38 when the pin 66 is inserted through the aligned holes 39 and the selectable one of the aperture pairs 37. The support assembly 30 also includes indicia 72 positioned proximate the aligned holes 39 for facilitating adjustment of the support assembly 30 to a proper height based on the distance between the shooter and the basketball hoop 2.

A support angle member 68 is couplable to the frame assembly 40 and the support assembly 30 such that the support angle member 68 extends between the frame assembly 40 and the support assembly 30 to provide support to the lower member 43 with minimal interference with the line of sight between the shooter and the basketball hoop 2.

In an embodiment, the support assembly 30 includes a plurality of coaxially positioned nested pipe members 31 which may include the first member 36 and the second member 38 as previously described. An innermost one of the pipe members 52 is couplable to the frame assembly 40 and an outermost one of the pipe members 54 is couplable to the base assembly 20. This facilitates maintaining a center of gravity of the support assembly 30 below a medial point of the extended support assembly 30 to prevent tipping of the training assembly 10 during use.

In an embodiment, the base assembly 20 has a hollow interior 24, a fill opening 26 and a drain opening 28. Thus, the hollow interior 24 may be filled with a weighting material such as sand or water for facilitating stable positioning of the base assembly 20.

The base assembly 20 may also include a plurality of wheels 29 for facilitating movement of the base assembly when filled. The wheels may be positioned such that they contact the ground only upon tipping of the base assembly 20. Thus, the assembly 10 is easily moved but stable when not tipped.

In an alternate embodiment of the base assembly 20, the base assembly 20 includes an elongated central member 56, an upper collar 58 coupled to the central member 56, a plurality of leg members 60, a lower collar member 62, and a plurality of leg support struts 64. Each leg member 60 has an upper portion pivotally coupled to the upper collar 58. The lower collar member 62 is slidably coupled to the central member 56. Each of the leg support struts 64 is pivotally coupled to extend between the lower collar member 62 and an associated one of the leg members 60 for permitting sliding of the lower collar member 62 on the central member 56. Thus, the leg members 60 are adjustable between an open position and a storage position. The number of leg members 60 provided is variable depending on desired characteristics with three providing minimum stability and lightest carrying weight for greater portability, five providing maximum stability and minimal tipping of the device during use.

In use, the training assembly is placed between a shooter and a basketball hoop. The opening in the frame is positioned by extending the support assembly. The frame is ultimately positioned such that the opening is at the peak of an arc extending between the shooter at the height of the shooter's hand and the height of the basketball hoop. The proper arc is further determined by an angle of entry into the basketball hoop by the basketball that maximizes the area of basketball hoop the basketball can pass through. Thus, the likelihood that the basketball will successfully pass through the basketball hoop is enhanced. For optimum results, the assembly would be adjusted for various positions around the basketball court and the shooter would practice repetitions of shooting through the opening.

It is further contemplated that the above invention may incorporate as yet unspecified counter systems for facilitating record keeping of successful and unsuccessful shooting attempts. Such an as yet undetermined system may include sensors for detecting and relaying an indication of portions of the device struck by an errant shot for purposes of analyzing shot faults.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A basketball shooting training system, comprising:

a base assembly;

a support assembly extending from said base assembly;

a frame assembly coupled to an upper end of said support assembly, said frame assembly forming an opening;

said base assembly and said support assembly being positionable such that said frame assembly is adapted for positioning between a shooter and a basketball hoop such that a basketball shot towards the basketball hoop such that the basketball passes through said opening approaches the basketball hoop at a desired downward angle for facilitating passing of the basketball through the basketball hoop;

a lower member, an upper member, a pair of sleeve members, and a pair of side members;

an upper end of each of said side members being coupled to an associated end of said upper member;

each of said sleeve members being coupled to an associated end of said lower member;

a lower end of each of said side members being insertable through an associated one of said sleeve members; and a pair of locking means, each locking means being for selectively holding an associated side member in a static position relative to said associated sleeve member whereby a distance between said upper member and said lower member is adjustable for selectively altering a level of difficulty for shooting the basketball through the opening.

2. The basketball shooting training assembly of claim 1, said base assembly further comprising:

an elongated central member;

an upper collar coupled to said central member;

a plurality of leg members, each leg member having an upper portion coupled to said upper collar;

a lower collar slidably coupled to said central member;

a plurality of leg support struts, each of said leg support struts being pivotally coupled to extend between said lower collar member and an associated one of said leg members for permitting sliding of said lower collar on said central member whereby said leg members are adjustable between an open position and a storage position.

3. The basketball shooting training assembly of claim 1, further comprising:

said base assembly having a plurality of wheels for facilitating movement of said base assembly.

4. The basketball shooting training assembly of claim 1, further comprising:

said support assembly being telescopically adjustable for adjusting a height of said opening.

5. The basketball shooting training assembly of claim 1, further comprising:

said support assembly including a biasing member for holding an upper end of said support assembly in an upright position for permitting bending of an upper portion of said support assembly when said frame assembly is struck whereby said support assembly is adapted for preventing tipping over of said base assembly when the basketball strikes said frame assembly.

6. The basketball shooting training assembly of claim 2, further comprising:

said plurality of legs being a number of legs chosen from the group of numbers of legs consisting of three legs, four legs and five legs.

7. The basketball shooting training assembly of claim 1, further comprising:

said frame assembly including a plurality of frame members, said frame members being removably coupled to each other whereby said frame is disassemblable for storing said frame assembly.

8. The basketball shooting training assembly of claim 4, further comprising:

said support assembly including a first member having a plurality of aligned aperture pairs extending through said first member, said aperture pairs extending along a length of said first member;

said support assembly including a second member, said second member including a pair of aligned holes alignable with a selectable one of said aperture pairs; and a pin insertable through said aligned holes and said selectable one of said aperture pairs whereby said first member is held in a static position relative to said second member when said pin is inserted through said aligned holes and said selectable one of said aperture pairs.

9. The basketball shooting training assembly of claim 1, further comprising:

said base assembly having a hollow interior, said base assembly further having a fill opening and a drain opening whereby said hollow interior is adapted for being filled with a weighting material for facilitating stable positioning of said base assembly.

10. The basketball shooting training assembly of claim 4, further comprising:

said support assembly including a plurality of coaxially positioned nested pipe members, an innermost one of said pipe members being coupled to said frame assembly, an outermost one of said pipe members being coupled to said base assembly.

11. A basketball shooting training system, comprising:

a base assembly;

a support assembly extending from said base assembly;

a frame assembly coupled to an upper end of said support assembly, said frame assembly forming an opening;

said base assembly and said support assembly being positionable such that said frame assembly is adapted for positioning between a shooter and a basketball hoop such that a basketball shot towards the basketball hoop such that the basketball passes through said opening at a top of an arc of a path of travel of the basketball whereby the basketball approaches the basketball hoop at a desired downward angle for facilitating passing of the basketball through the basketball hoop;

said support assembly being telescopically adjustable for adjusting a height of said opening;

said support assembly including a biasing member for holding an upper end of said support assembly in an upright position for permitting bending of an upper portion of said support assembly when said frame assembly is struck whereby said support assembly is adapted for preventing tipping over of said base assembly when the basketball strikes said frame assembly;

said frame assembly further comprising a lower member, an upper member, a pair of sleeve members, and a pair of side members, an upper end of each of said side members being coupled to an associated end of said upper member, each of said sleeve members being coupled to an associated end of said lower member, a lower end of each of said side members being insertable through an associated one of said sleeve members, a pair of locking means, each locking means being for selectively holding an associated side member in a static position relative to said associated sleeve member whereby a distance between said upper member and said lower member is adjustable for selectively altering a level of difficulty for shooting the basketball through the opening;

an upper end of said support assembly being coupled to said lower member of said frame assembly at a position offset from a center of said lower member whereby said support assembly is positioned for facilitating clear viewing of the basketball hoop by the shooter when said basketball shooting training system is positioned between the shooter and the basketball hoop;

said lower member, upper member, and said side members of said frame assembly being removably coupled to each other whereby said frame is disassemblable for facilitating storage of said frame assembly;

said support assembly including a first member having a plurality of aligned aperture pairs extending through said first member, said aperture pairs extending along a length of said first member;

said support assembly including a second member, said second member including a pair of aligned holes alignable with a selectable one of said aperture pairs;

a pin insertable through said aligned holes and said selectable one of said aperture pairs whereby said first member is held in a static position relative to said second member when said pin is inserted through said aligned holes and said selectable one of said aperture pairs;

said first member having indicia positioned proximate said hole pairs for indicating a proper height adjustment for a predetermined distance between the shooter and the basketball hoop;

a support angle member coupled to said frame assembly and said support assembly such that said support angle extends between said frame assembly and said support assembly;

said support assembly including a plurality of coaxially positioned nested pipe members, an innermost one of said pipe members being coupled to said frame assembly, an outermost one of said pipe members being coupled to said base assembly.

12. The basketball shooting training assembly of claim 11, further comprising:

said base assembly having a hollow interior, said base assembly further having a fill opening and a drain opening whereby said hollow interior is adapted for being filled with a weighting material for facilitating stable positioning of said base assembly.

13. The basketball shooting training assembly of claim 12, further comprising:

said base assembly having a plurality of wheels for facilitating movement of said base assembly.

14. The basketball shooting training assembly of claim 11, said base assembly further comprising:

an elongated central member;

an upper collar coupled to said central member;

a plurality of leg members, each leg member having an upper portion coupled to said upper collar;

a lower collar slidably coupled to said central member;

a plurality of leg support struts, each of said leg support struts being pivotally coupled to extend between said lower collar member and an associated one of said leg members for permitting sliding of said lower collar on said central member whereby said leg members are adjustable between an open position and a storage position.

15. The basketball shooting training assembly of claim 14, further comprising:

said plurality of legs being a number of legs chosen from the group of numbers of legs consisting of three legs, four legs and five legs.

16. The basketball shooting training assembly of claim 4, further comprising:

said support assembly having indicia for indicating a proper height adjustment for a pre-determined distance between the shooter and the basketball hoop for facilitating adjustment of said support assembly.

17. The basketball shooting training assembly of claim 1, further comprising:

frame indicia on each of said side members for facilitating positioning of said side members such that said upper member is adjustable to a level position and for facilitating consistent setting of a desired level of difficulty.

* * * * *